United States Patent [19]

Hori

[11] 4,201,801

[45] May 6, 1980

[54] METHOD OF FORMING A DECORATIVE RELIEF PATTERN

[75] Inventor: Kiyoshi Hori, Suita, Japan

[73] Assignee: Nippon Paint Co., Ltd., Osaka, Japan

[21] Appl. No.: 919,694

[22] Filed: Jun. 27, 1978

Related U.S. Application Data

[63] Continuation of Ser. No. 802,197, May 31, 1977, abandoned, which is a continuation of Ser. No. 686,218, May 12, 1976, abandoned, which is a continuation-in-part of Ser. No. 472,460, May 22, 1974, abandoned.

[51] Int. Cl.[2] ..... B05D 5/00

[52] U.S. Cl. ..... 427/274; 29/121.1; 401/197; 427/278

[58] Field of Search ..... 427/264, 278, 280, 428, 427/274; 264/284, 293; D64/18; 29/121.1, 121.2, 121.4, 121.5, 121.6, 121.7, 121.8; 118/212; 401/197; 101/328, 329, 330, 331

[56] References Cited

U.S. PATENT DOCUMENTS

| | | | |
|---|---|---|---|
| 53,922 | 4/1866 | Halsey et al. | 29/121 R |
| D. 241,374 | 9/1976 | Hori | D64/18 |
| D. 241,375 | 9/1976 | Hori | D64/18 |
| 269,144 | 12/1882 | West | 117/10 |
| 665,336 | 1/1901 | Meier et al. | 29/121 A X |
| 1,436,155 | 11/1922 | Domy | 29/121 A X |
| 1,573,594 | 2/1926 | Winkenbach | 29/116 R |
| 2,485,428 | 10/1949 | Bleier et al. | 29/121 H X |
| 2,577,241 | 12/1951 | Gibson et al. | 264/293 |
| 2,616,367 | 11/1952 | Sprung | 29/121 H |

FOREIGN PATENT DOCUMENTS

| | | | |
|---|---|---|---|
| 430284 | 6/1935 | United Kingdom | 117/11 |

*Primary Examiner*—Evan K. Lawrence

*Attorney, Agent, or Firm*—Wenderoth, Lind & Ponack

[57] ABSTRACT

A decorative relief pattern is formed on an article or substrate by first forming a layer of highly viscous material on the surface of the article or substrate, followed by applying a plurality of times to such a layer a roller having a surface design arrangement formed of a single design unit, or of several single design units, each design unit being made up of curved, linear convex bodies. The linear bodies may in fact be continuous lines or disconnected lines. Alternatively, the pattern is formed by applying the roller several times to the surface of the article or substrate while at the same time feeding the highly viscous material thereto. The method can provide an article or substrate with a decorative relief pattern having no directional traces in the direction of the rotary movement of the roller.

16 Claims, 31 Drawing Figures

METHOD OF FORMING A DECORATIVE RELIEF PATTERN

This is a continuation of application Ser. No. 802,197, filed May 31, 1977, now abandoned, which is a continuation of application Ser. No. 686,218, filed May 12, 1976, now abandoned, which is a continuation-in-part of application Ser. No. 472,460, filed May 22, 1974, now abandoned.

BACKGROUND OF THE INVENTION

This invention relates to a method of forming a decorative relief pattern on the surface of a substrate by the use of a highly viscous material such as paint to form a layer on the substrate, and a patterned roller to form a pattern on the viscous layer.

Hitherto, various methods of forming patterns on layers of highly viscous material by the use of rollers have been used, but the patterns thus formed are affected by the surface conditions or configuration of the roller, or the pattern engraved thereon, and are also affected by the rotation and direction of movement of the roller. Various rollers hitherto used have plain surfaces or are engraved with a transfer pattern or a relief pattern. When forming a pattern on the article or substrate by the use of such rollers, the roller is usually moved only in a single direction over the article or substrate by mechanical or manual movement, each area of the article or substrate being rolled only once in order to avoid forming directional traces of the direction of the rotary movement of the roller. When a plain surfaced roller is used, the "pattern" thus formed is a flat surface. When a porous elastomer is used, a stippled pattern of delicate relief appearance is formed. In the case of the use of transfer and relief rollers, a flat or slightly uneven print pattern is formed, and in either case the resultant pattern corresponds to the configuration of the surface of the roller and is a series of repeating patterns formed along the direction of rotary movement of the roller. That is, the pattern can be classified as a directional pattern.

In forming the pattern by the above method, it is the normal practice to move the roller to complete a first row and then the roller is displaced by the width thereof at right angles to the direction of movement and the roller is then moved parallel to the former row to complete a second row, and thus, by repeating this motion, patterns can be formed on the entire surface of the article or substrate. In such a method, the boundary lines between the rows become visible, thereby imparting directional traces to the finished pattern. This is more conspicuous when the pattern is formed by transfer printing or reliefing. Accordingly, the article or substrate impressed with the formed pattern sustains a great loss in its commercial value, since directional trances are visible in the direction of the rotary movement of the roller.

The desired pattern may be applied to the article or substrate, for example, a wall element, at a factory, but in practice such work is usually carried out at the location where the article or substrate is used to form the completed structure. In these circumstances, the design is usually applied by the manual use of a roller. However, depending on the prevailing circumstances and other factors, it may be sometimes very difficult to move the roller in a single direction over the entire surface to be patterned and, as a result, to form the desired pattern uniformly over the whole surface of a wall element with conventional rollers. This is particularly so when a wide surface area should be patterned. To overcome this difficulty it is an ordinary practice to use a roller made of a porous elastomer. With this roller, however, it is very difficult to form the pattern uniformly over the whole area, thus necessitating a modification of the pattern from time to time by varying the direction of application of the roller or by overlapping the 'runs' of the roller. Such practices of course give rise to directional traces in the pattern as described above. Furthermore, overlapping applications of the roller are apt to cause an undesirable roping phenomenon (this is linear unevenness formed on highly viscous materials in the direction of rotary movement of the roll), thus inhibiting the uniform formation of the desired pattern.

When using highly viscous materials for the pattern forming material and forming the pattern by the rotary application of an ordinary roller, there have therefore been drawbacks such that the formed pattern is directly affected by the shape of the surface of the roller, and the pattern formation may present undesirable phenomena depending on the conditions of application of the roller.

SUMMARY OF THE INVENTION

It is an object of the present invention to provide a method of forming a decorative uneven pattern in relief on the surface of an article or substrate, such pattern being substantially free of directional traces.

According to the invention, there is provided a method for forming a decorative uneven pattern on the surface of an article or substrate, such method including: providing a layer of highly viscous material on a surface of an article or substrate to be patterned, providing a roller having formed on the surface thereof a roller design arrangement comprising a design unit or a plurality of single design units arranged asymmetrically and substantially equally spaced with respect to each other, each such single design unit being formed of curved, linear convex body or bodies (projections), and applying the roller over the layer of highly viscous material a plurality of times.

BRIEF DESCRIPTION OF THE DRAWINGS

Preferred embodiments of the invention are described in detail in the following, in which reference is made to the accompanying drawings, in which.

DETAILED DESCRIPTION OF THE INVENTION

A roller in accordance with one embodiment of the present invention is provided on its roll surface with a roller design arrangement which is constituted by a single design unit or a plurality of single design units. The single design unit may be composed of a single design element or plural design elements in the form of a curved linear shape, as viewed by removing and flattening the surfaces of rollers having such design elements. The curved linear shape may be a continued or discontinued linear shape. The linear shape should be formed by a convex body or projection having a plain surface on top. Where a design element is constituted by discontinued linear shapes, they should form a curved design element as a whole even if a line segment thereof, when taken alone, were in the form of a substantially straight linear shape. In other words, the design elements composed of discontinued linear shapes should be formed as if the design element of the continued linear shape were cut into a plurality of line segments constituting the curved design element as a whole.

Figure 1A:
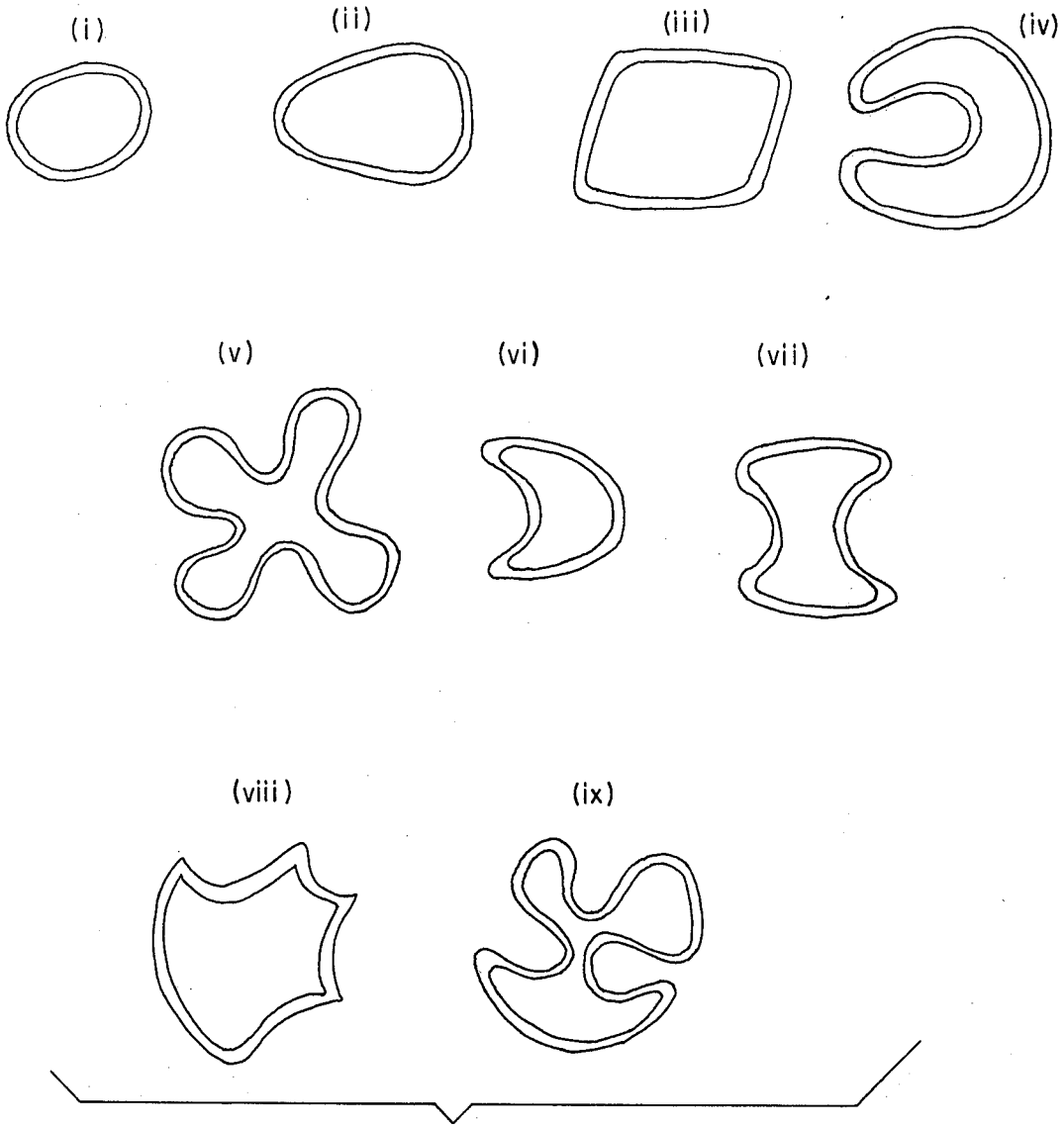
FIGS. 1A-1C are schematic views illustrating various design elements which may be formed on the surface of a roller for carrying out the present invention.
Figure 1B:
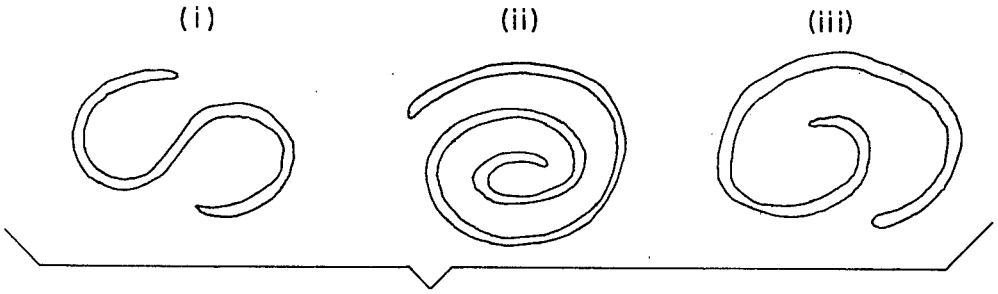
Figure 1C:
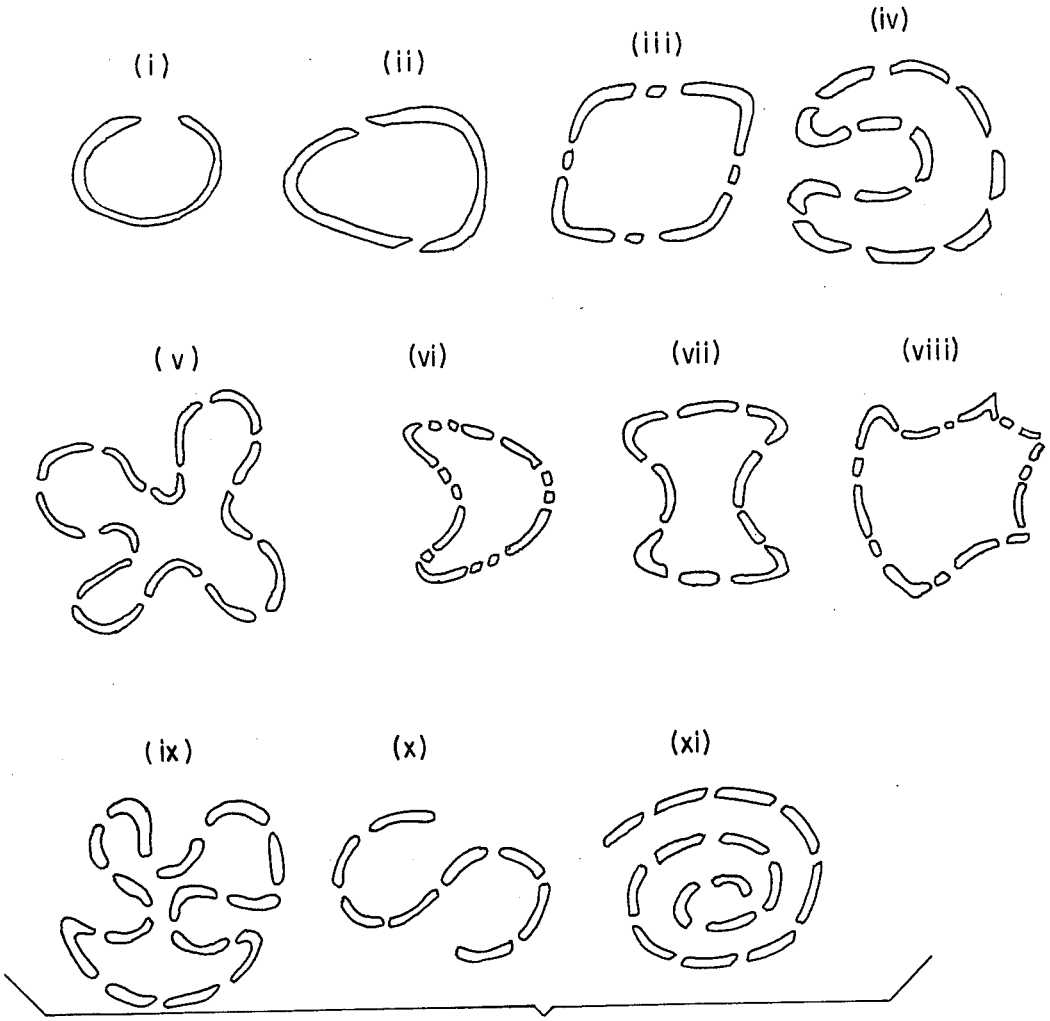

Typical design elements are shown in FIGS. 1A–1C in which there are, for example, closed annular or shaped annular design elements as seen in FIGS. 1A and 1B. Specifically, in FIG. 1A, there are shown a full circle as in (i); a shaped annular design element as in (ii), (iii), (iv) and (v); and a combination of curved line segments constituting a closed shaped annular element as in (vi), (vii), (viii) and (ix). FIG. 1B shows an S-shaped design element as in (i) and a spiral design element as in (ii) and (iii). In FIG. 1C, there are shown open annular or shaped annular design elements having the same shape as a whole as seen in FIGS. 1A and 1B but being formed by discontinued linear shapes. The italic numerals (i) to (ix) in FIG. 1C correspond to those of FIG. 1A and (x) and (xi) to those numerals (i) and (ii) of FIG. 1B, respectively. The design elements within the scope of the invention should not be construed as being limited to those shown therein. They are merely illustrative, and it should be noted that variations and modifications over a very wide range, which can be derived from the design elements of FIGS. 1A and 1B, are possible and that they should be understood to be included within the scope of the present invention. For example, the annular design elements as seen in FIG. 1A(iii) to (ix), inclusive, may have more or fewer line segments; and the S-shaped and spiral design elements as shown in FIGS. 1B(i) and 1B(ii), respectively, may have more or fewer curves and circles or spirals.

Figure 2C:
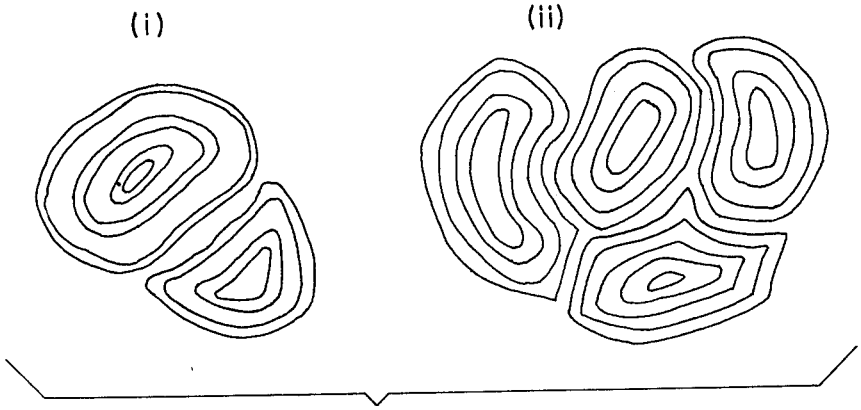
FIGS. 2A-2D are each a schematic view illustrating various design units constituted by the design elements to be formed on the surface of a roller for carrying out the present invention.
Figure 2A:
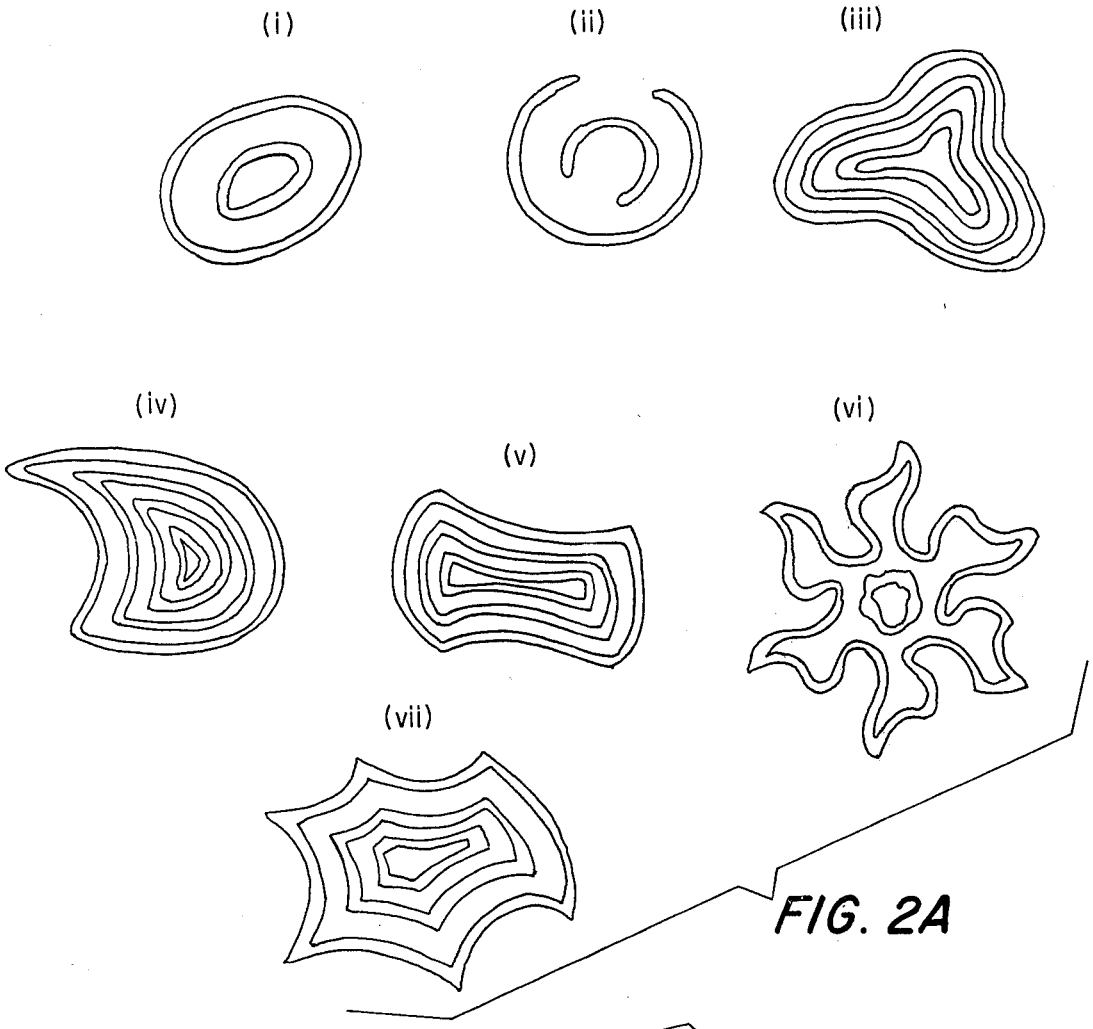
Figure 2B:
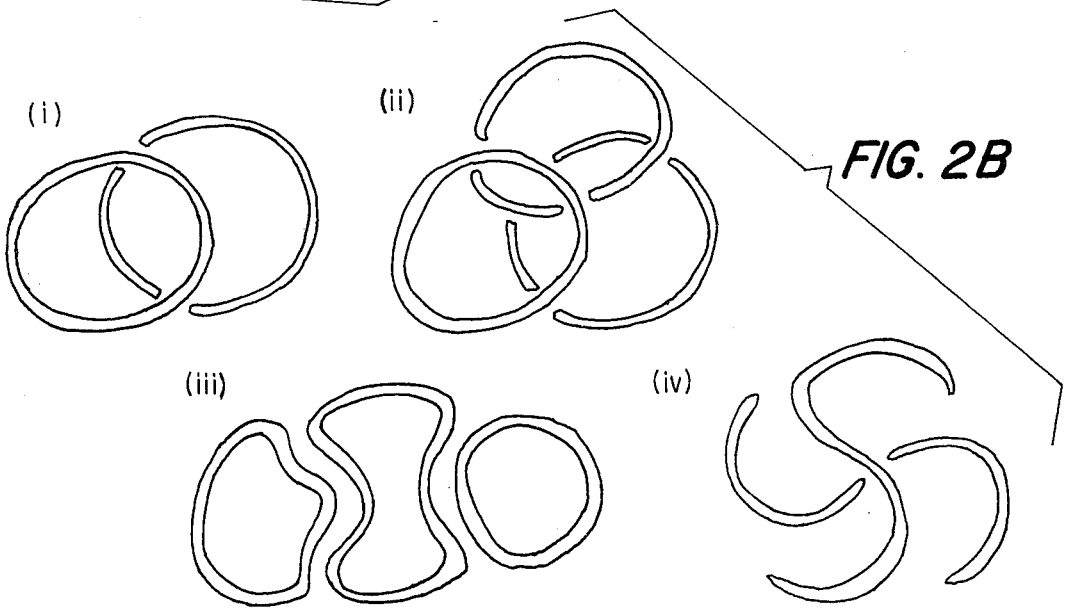
Figure 2D:
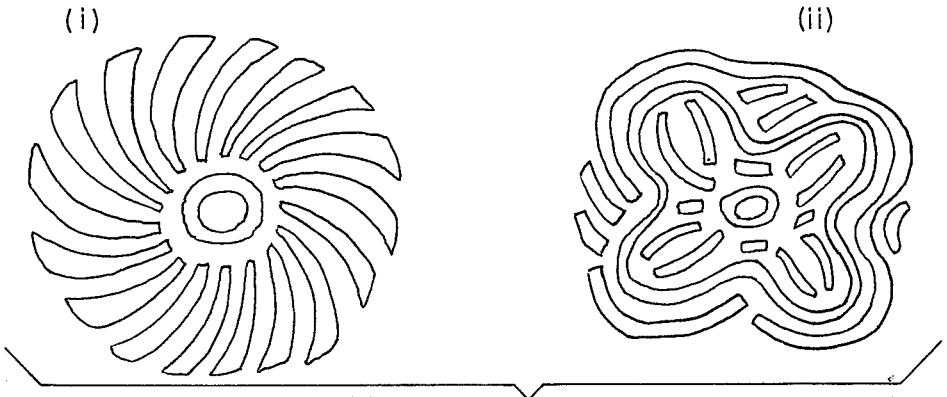

FIGS. 2A to 2D show some illustrative embodiments of a single design unit or plural design units constituted by the design elements as have been illustrated in FIGS. 1A, 1B, and 1C. The design units may be divided generally into several groups such as, for example, a group composed of a combination of design elements in which they are arranged so as to have a common center, as in FIG. 2A; a group composed of a combination of design elements in which they are arranged in a side-by-side relationship or in which they are positioned so as to overlap with each other, as shown in FIG. 2B; a group composed of a combination of the group as referred to in the former group with the group as referred to in the latter group, as shown in FIG. 2C; and a group composed of design elements combined with curved linear design elements in the form of projections, as shown in FIG. 2D.

In FIG. 2A, there are specifically shown closed or open multi-fold circles, e.g., concentric circles, as seen in (i) and (ii), and shaped concentric annular design elements as seen in (iii), (iv), (v), (vi) and (vii). FIG. 2B shows specific embodiments of design units composed of a combination of a plurality of design elements having shapes substantially similar to or different from each other. For example, the design units can include an arrangement in which the design elements constituting the design unit are arranged in a side-by-side manner and overlapping with each other, as shown in (i) and (ii), and an arrangement in which a plurality of design elements are arranged merely in a side-by-side manner or they are positioned so as to be in a cross-shaped form, as in (iii) or (iv), respectively. Where a plurality of the design elements are arranged in an overlapping manner, it is preferred that the linear projection of one or the other of the design elements be cut off at the areas of intersection, as shown in (i) and (ii). FIG. 2C illustrates design units composed of a combination of design units as shown in FIG. 2A(i), (iv), (v) or (vi) in which they are arranged in a side-by-side manner. FIG. 2D(i) shows a design unit in which the unit may be composed of a combination of an annular design unit as shown in FIG. 2A(i) with linear projections or linear design elements arranged in radial directions from the annular design unit, and FIG. 2D(ii) shows a design unit made of a combination of a design unit similar to that shown in FIG. 2A(iii), with annular design elements, as shown in FIG. IA(i) or (ii). It is, of course, to be understood that the design units constituting the roller design arrangement and the design elements composing the design units should not be construed as being limited to those illustrated in the drawings since they may be modified or altered over a wide variety. Although the design units which are shown in FIGS. 2A, 2B, 2C, and 2D are composed of continued linear shapes alone, it is apparent from the foregoing description that they may be formed by discontinued linear shapes. The same can apply for all the other drawings in which the projected linear shapes on the roller surface are drawn as continued linear shapes.

In providing a roller having a roll surface with a roller design arrangement, the design unit or units constituting the roller design arrangement should be arranged to meet the following requirements.

The design elements and the design units are provided in such a manner that they are arranged substantially equally spaced with respect to each other.

More specifically, the roller design arrangement may be composed of a single design unit as shown in FIG. 2A. Where the design unit is comprised of design elements having a common center, the design unit is positioned such that a space or a depression between one projected design element and another neighboring element is substantially equal to a space between the latter element another neighboring or located next thereto, when taken along a line passing through the common center. The single design unit is formed throughout the roll surface, giving a roller as shown in FIG. 3A in which the design elements are in the form of continued linear shapes, or as shown in FIG. 3B and 3C in which they are in the form of discontinued linear shapes.

Figure 3D:
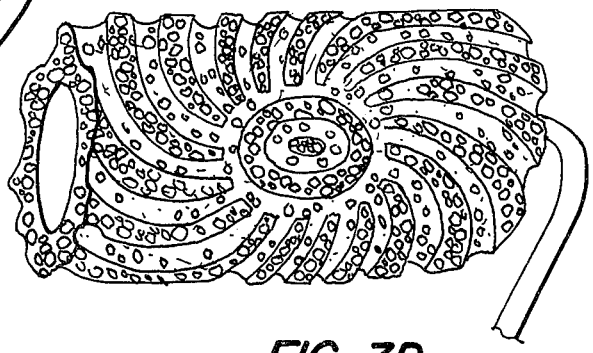
Figure 3E:
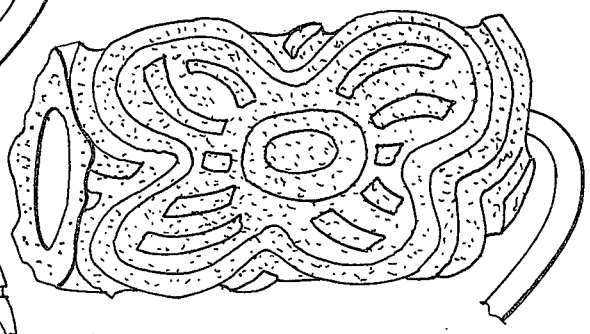
Figure 4A:
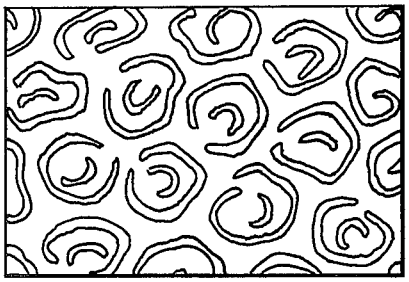
FIGS. 4A-4F are schematic views of roller design arrangements to be formed on the roll surfaces of rollers for carrying out the present invention.
Figure 4B:
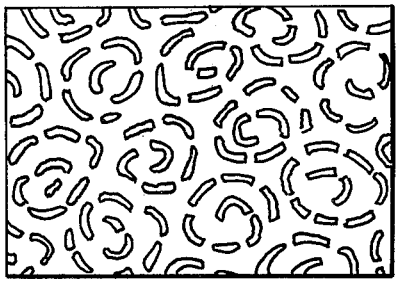
Figure 4C:
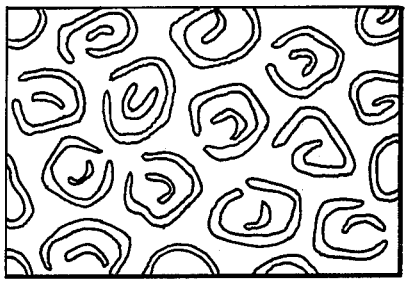
Figure 5A:
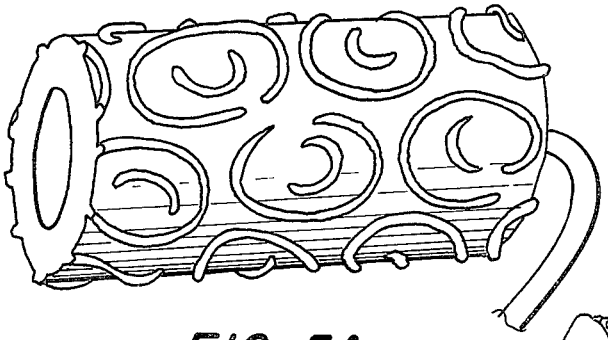
FIGS. 5A-5F are perspective views of rollers having the roller design arrangements as shown in FIGS. 4A-4F.
Figure 5D:
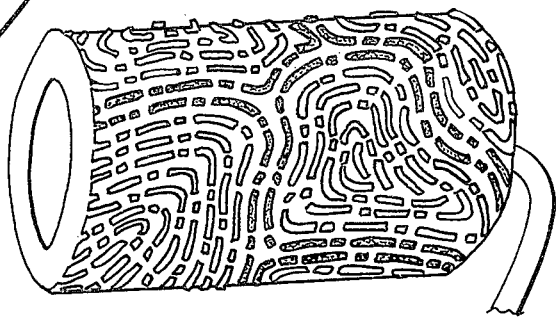
Figure 5B:
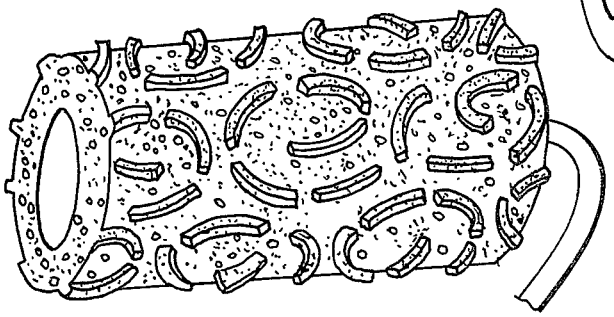
Figure 5E:
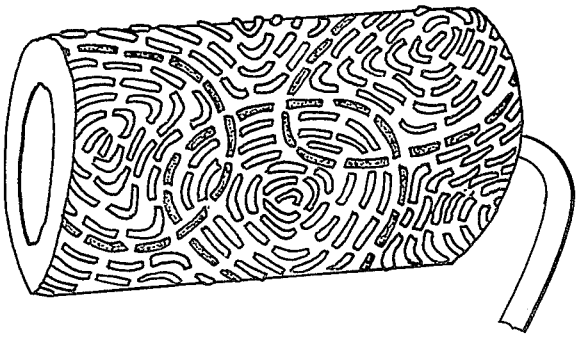
Figure 5C:
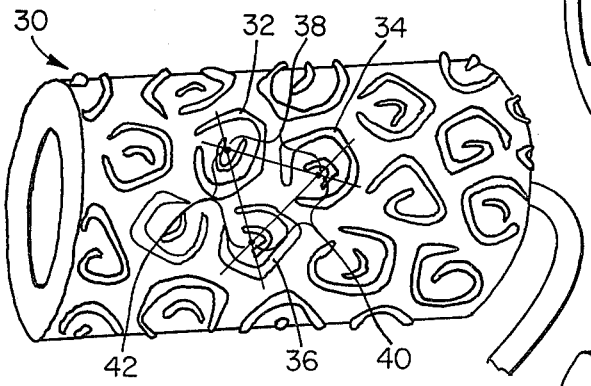

In another feature of the roller design arrangement, it is composed of plural design units which should be arranged asymmetrically and substantially equally spaced with respect to each other. Where the roller design arrangement is composed of design units as shown in FIGS. 2A, 2B, and 2C, they may further be so arranged that one of the design units is positioned from a neighboring unit at a distance substantially equal to a distance between a design unit and another design unit located next thereto, and so on, when taken along a line passing through the corresponding two centers of the units which are situated next to each other. For example, as shown in FIGS. 4A, 4B and 4C, the roller design arrangements are combinations of design units which are dimensioned and positioned to meet the above requirements. Rollers carrying such design units are shown in FIGS. 5A, 5B and 5C. Furthermore, as in FIG. 2B(iii), for example, the design units are so arranged that a distance between the center of an annular design element and the line segment thereof is substantially equal to a distance between such line segment and the line segment, facing the former segment, of another design element, i.e. a shaped annular design element, and further to a distance between this latter line segment and the center of the shaped annular design element, when taken along a line passing through the two centers of the design elements. Such a relation can be applied to other design units as shown in FIG. 2B. This relation is also applicable in an identical manner to a design unit as in FIG. 2C with respect to a relation between the two single design units constituting the plural design units neighboring each other. In this case, the relation within each of the single design units should meet the relation as stated in the paragraph preceding immediately this paragraph. Where the roller design arrangement consists of a design unit, as shown in FIG. 2D(i) or (ii), the design elements constituting the design unit are arranged such that they are substantially equally spaced with respect to each other and they are formed over the whole area of the roll surface. More specifically, for example, in FIG. 2D(i), the annular design elements are arranged to meet the relation as set forth above under the roller design arrangement composed of the design units as shown in FIG. 2A. And other elements, i.e. linear design elements, constituting the design unit of FIG. 2D(i) are formed apart from the annular design element at a distance substantially equal to the distance between the annular design elements, and the linear design elements are arranged substantially equally spaced with respect to each other. A roller having such a single design unit as shown in FIG. 2D(i) or 2D(ii) is shown in FIG. 3D or 3E.

Figure 4D:
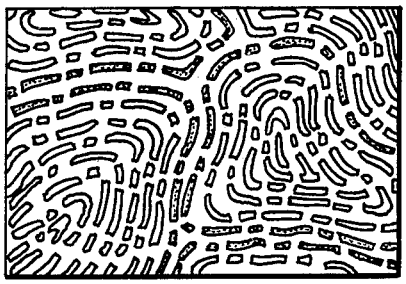
Figure 4E:
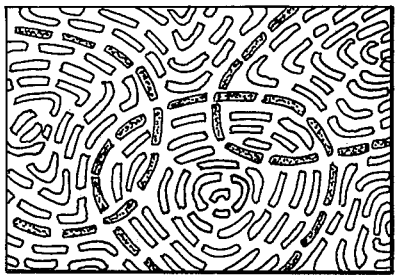
Figure 4F:
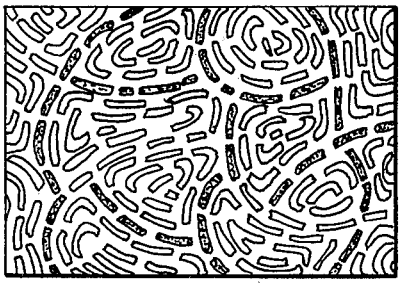
Figure 5F:
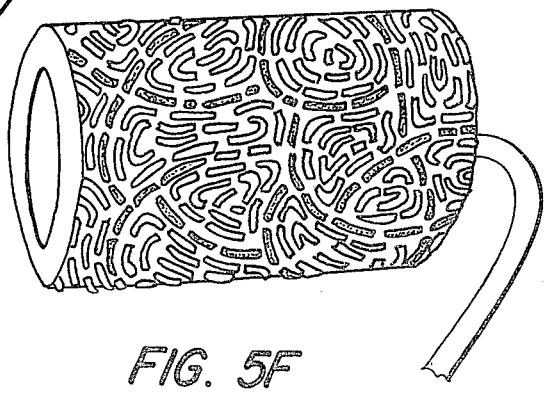

In a further feature of a roller design arrangement which consists of plural design units, they may be arranged asymmetrically and substantially equally spaced with respect to each other, when viewed by removing and flattening the surface of the roll. They are arranged such that a distance between one design unit and a neighboring design unit is substantially equal to a distance between the former and another neighboring unit, and so on, when taken along a line through the centers of two units located next to each other. The roller design arrangement may be a combination of design units of the type having substantially the same shape, as shown in FIGS. 4A and 4B, or a combination of design units of the type having different shapes as shown in FIG. 4C or of type composed as illustrated in FIG. 2C(i) or (ii), as shown in FIG. 4D, 4E or 4F. Rollers carrying on their roll surfaces the roller design arrangement as shown in FIG. 4D, 4E or 4F are illustrated in FIG. 5D, 5E or 5F.

Figure 3A:
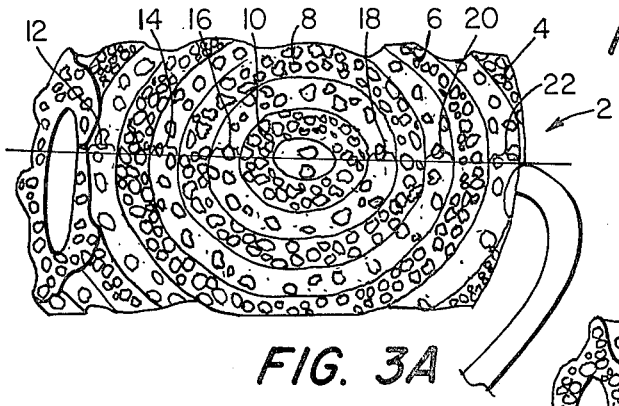
FIGS. 3A-3E are perspective views of roller provided on the roll surfaces thereof with a rollers design arrangement constituted by various single design units, according to the present invention.
Figure 3B:
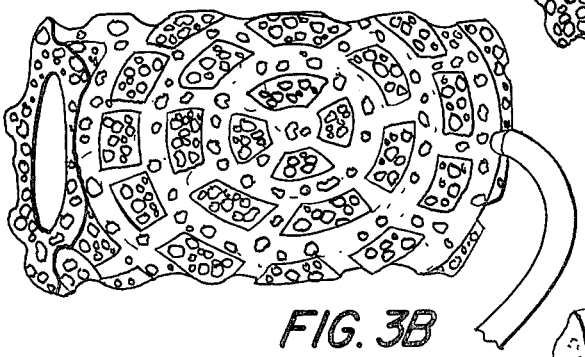
Figure 3C:
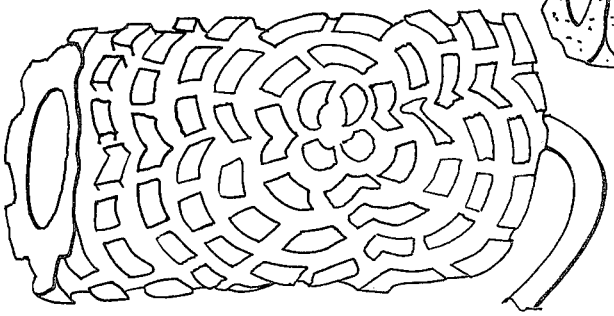

With reference now to FIG. 3A of the drawings, there is illustrated the above discussed spacing between adjacent design elements of a single design unit which forms the entire design arrangement on the surface of a roller. Thus, in FIG. 3A there is shown a roller 2 having on the roller surface thereof a design arrangement which is formed by a single design unit. This single design unit is formed of a plurality of design elements, for example design elements 4, 6, 8 and 10, arranged around a common center of the single design unit. As shown, each design element is in the form of a projection extending outwardly from the roller surface, and each projection extends in an elongated curved manner and has a flat outer top surface. The design elements are positioned with respect to each other such that the spacings between any adjacent two of the design elements, taken along a straight line extending through the common center of the single design unit, are substantially equal. In other words, as taken along the straight line passing through the center of the design unit shown in FIG. 3A, spacings 12, 14, 16, 18, 20 and 22 are formed between various adjacent pairs of design elements, and these spacings are all substantially equal.

It is believed to be readily apparent that the above spacing relationships will similarly be found in the arrangements of FIGS. 3B through 3E, showing other arrangements wherein a single design unit covers the entire roller surface.

With reference now to FIG. 5C of the drawings, there will be illustrated the above discussed spacing relationship between adjacent design units of a design arrangement including a plurality of design units. Specifically, a roller 30 has on a roller surface thereof a design arrangement including a plurality of design units which together occupy the entire area of the roller surface. FIG. 5C includes a plurality of design units, including the referenced design units 32, 34 and 36 which are adjacent each other. Each of the design units has a center, as is indicated with respect to design units 32, 34 and 36. The design units are asymmetrically and substantially equally spaced with respect to each other, with substantially equal distances between the centers of any adjacent two of the design units. In other words, the distance 38 between the centers of adjacent design units 32 and 34 is substantially equal to the distance 40 between the centers of adjacent design units 34 and 36, is substantially equal to the distance 42 between the centers of adjacent design units 36 and 32.

It is believed to be readily apparent that similar spacing relationships are provided between the respective design units of design arrangements including plural design units of the various rollers illustrated in FIGS. 5A, 5B and 5D through 5F.

The size of a particular single design unit can be adequately determined according to the size of the roller to be used. The same applies to the intervals between the curved convex bodies forming a particular single design unit in relief and the spacing between adjacent units, which may normally be from 3 to 50 mm., or preferably from 5 to 20 mm. The continuous line or shapes or the disconnected line or shapes which constitute the curved convex bodies will have a thickness determined by the particular single design unit size, and will normally be from 1 to 50 mm., or preferably from 2 to 20 mm. The elevation or height of the projections will normally be from 1 to 50 mm. or preferably from 2 to 20 mm.

The material forming the roller in the present invention may be either an elastic material or a non-elastic material. When using an elastic material, the material is required to have such a degree of elasticity that the combined roller design configuration of the roll is not fully deformed under pressures appropriate to provide a relief pattern on the coating surface at the time of forming the pattern on the article or substrate to be patterned. Normally, the highly viscous material will be an aqueous substance, but an organic solvent based substance may also be used. Accordingly, the roller should preferably be made of a solvent-resistant material, or suitably of a special rubber or plastics material.

The highly viscous material to be used in the method of the present invention is required to have a viscosity such that the relief pattern formed by the application of the roller as described hereinabove to such layer of viscous material does not readily change until it is hardened by the inherent material properties or by an exterior hardening treatment. Consequently, the viscous material may have a viscosity ranging from about 2,000 to 50,000 centipoise. The degree of viscosity has an effect upon the finish of the pattern formed by the roller. For example, the use of a material having a low viscosity results in the formation of an uneven pattern which generally gives a soft feel. Thus a suitable viscous material can be chosen for each application. Examples of such materials are paint, cement, plaster, mortar and clay, which may be used either singly or in a mixture.

In one embodiment of the method of the present invention, a layer of the highly viscous material is placed in advance on the surface of the article or substrate to be patterned. The thickness of the layer may be appropriately determined according to the amount of unevenness of the pattern to be formed and the elevation or height of the pattern-shaping convex bodies on the surface. The roller may be applied to the layer either mechanically or manually several times, preferably from two to five times, to the same portion of the layer, thereby forming a desired decorative relief pattern on the surface of the coating. Such application of the roll may be effected either with a single roll or with several rolls combined. The rotary application of the roller may be effected either repeatedly over the same zone, or by gradually displacing the zones of movement of the roller in a parallel manner, or in an irregular intersecting manner.

Heretofore it has been regarded as practically impossible or very difficult, with conventional pattern-forming techniques, to apply the roll with such frequency as described above. Moreover, it has been considered that the application of the roll in the above manner would cause such undesirable conditions as the appearance of the roping phenomenon and directional traces in the pattern. However, the use of a roller having the novel surface shape as above described renders possible the application of the roller in the above manner in accordance with the method of the present invention. Accordingly, the decorative relief patterns formed by the method of the present invention are new fancy patterns, the formation of which is quite beyond ordinary skill when using conventional techniques, such as transfer printing, wherein the formed pattern is significantly reflected by the surface shape of the roll applied. That is, in the present invention, the resultant pattern is not a direct image of the shape of the surface of the roller.

In another embodiment of the present invention, the roller is applied at the same time as feeding a highly viscous material onto the article or substrate to be patterned. The system of feeding the viscous material may be, for example, to make the inside of the roller hollow, such hollow space communicating with the concave portions of the roller surface, and to feed the viscous material under pressure by suitable means to the hollow portion of the roller so that it is extruded out onto the surface thereof. Also, when using a roller consisting of a foamed elastomer, the roller may be immersed into the viscous material and then applied to the surface to be patterned.

After the desired relief pattern has been formed, the viscous material is solidified by its inherent hardening property or by known external hardening means. In this way, the desired decorative relief pattern is obtained. Thereafter, a tinting pigment may be applied as desired. When the relief pattern is semi-solidified, the top of the convex portion of the pattern beyond a specified height may be preferably flattened with a spatula, a float, or flat-surfaced roller, or sanded with a sanding device. It is to be noted, however, that the relief pattern formed can also be used for decorative purposes without flattening its projection beyond a certain height to a uniform thickness. Then, by tinting the whole area of the decorative relief pattern, followed by finishing only the levelled top surface of the projections above the surrounding ragged surface with a different colour, a further fancy relief pattern can be obtained.

Figure 6A:
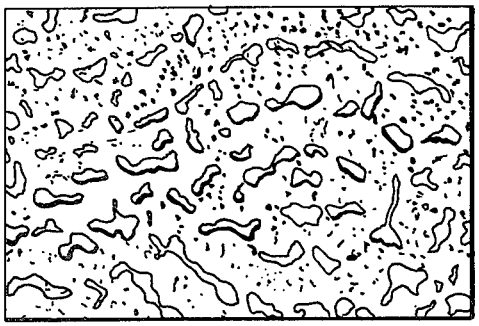
FIGS. 6A-6G are diagrams illustrating decorative relief patterns finished by levelling the top portion of relief patterns beyond a given height to a uniform thickness, the relief patterns being formed by rollers according to the present invention.
Figure 6B:
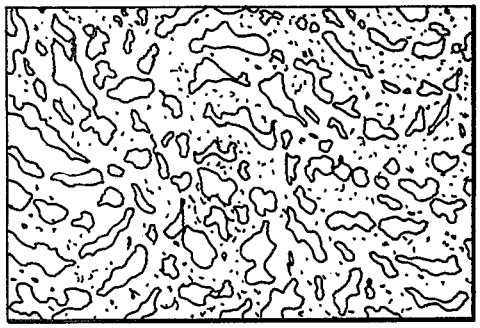

Specifically, FIGS. 6A to 6G each illustrate decorative relief pattern formed on the coating surface with rollers as shown in FIGS. 3B, 3D, 5A, 5B, 5D, 5E and 5F and 5A to 5E, respectively, followed by levelling the top portions thereof beyond a given height to a uniform thickness. In FIGS. 6A to 6G, it should be understood that a spacing between the levelled coating surface is a ragged surface having a number of projections of varying heights below the thickness of the levelled surface. In FIG. 6A, the lines are projections on the surface of the coating.

The following Examples illustrate the present invention without, however, limiting the same thereto.

EXAMPLE 1

(1) Roller

A roller of non-elastic polyvinyl formal material (KANEFIL R No. 2110 trade mark of Kanebo), with its surface filled up with epoxy-resin surfacer, having an inner diameter of 40 mm., an outer diameter of 72 mm., and a length of 180 mm. on the surface of which is formed the combined roller design arrangement of FIG. 5A, was used. The size of each single design unit was 30–40 mm. both lengthwise and breadthwise, with a 5–10 mm. spacing between adjacent units. The thickness of the convex bodies was 2–4 mm. and the height of the convex bodies was 3–4 mm.

(2) Highly viscous material

| | |
|---|---|
| Paint Solution: | |
| Epoxy resin | 29.0 (% by wt.) |
| Extender pigment | 59.0 (% by wt.) |
| Tinting pigment | 4.0 (% by wt.) |
| Solvent | 8.0 (% by wt.) |
| Hardener: | |
| Hardener | 30.0 (% by wt.) |
| Stabilizer | 0.3 (% by wt.) |
| Additive | 3.0 (% by wt.) |
| Extender pigment | 59.0 (% by wt.) |
| Solvent | 6.5 (% by wt.) |

An epoxy resin thick-coating paint available on the market, to be formed by mixing the paint solution and the hardener of the above composition in a ratio of 4:1 (% by weight), was used. The viscosity of the paint was 48,000 centipoise (at 25° C.).

(3) Uneven pattern formation

A layer of viscous material was formed by evenly applying 42 g. of the above viscous material to a flexible board (slate board) (300 mm.×200 mm.×3 cm.) with a wooden spatula, to which the above described roller was applied twice in the lengthwise direction, once along a left diagonal direction, and once along a right diagonal direction (four times in total).

(4) After-treatment

After forming the uneven pattern, the material was left at room temperature for 15 hours. The tops of the convex portions of the uneven pattern thus solidified were polished and flattened with sand paper. Then, the entire surface of the uneven pattern was spray-coated with polyurethane resin enamel (light green). This was left for five hours, and after it had dried, the same enamel (dark green) was applied only to the top of the convex portions with a roller.

Figure 6C:
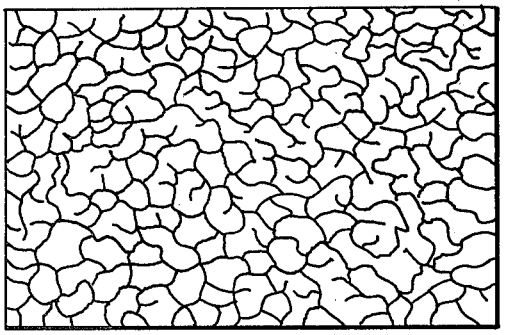

(5) The relief pattern thus formed appeared to have a soft texture similar to the skin of melon, as shown in Figure FIG. 6C, was suitable for interior finishing of a building (such as a lounge, parlour, lobby or bathroom).

EXAMPLE 2

(1) Roller

A roller of an elastic polyvinylalcohol material (made by Kanebo) having an inner diameter of 38 mm., an outer diameter of 80 mm., and a length of 180 mm. on the surface of which was formed the combined roller design arrangement of FIG. 4B, was used. The size of each single design unit was 40–60 mm. lengthwise, 60–90 mm. breadthwise, with a 10–15 mm. spacing between adjacent units. The thickness of the convex bodies was 5–7 mm., and the height of the convex bodies was 6–7 mm.

(2) Highly viscous material

| | |
|---|---|
| Vinylacetate vasatic emulsion | 16.0 (% by weight) |
| Extender pigment and filler | 60.0 (% by weight) |
| Tinting pigment | 10.0 (% by weight) |
| Thickner | 0.5 (% by weight) |
| Stabilizer | 0.2 (% by weight) |
| Defoamer | 0.4 (% by weight) |
| Mildwicide | 0.4 (% by weight) |
| Water | 12.5 (% by weight) |

A vinylacetate vasatic emulsion type heavy-bodied paint of the above composition, which is available on the market, was used. The viscosity of the paint was 22,000 centipose (at 18° C.).

(3) Uneven pattern formation

Prior to the formation of the pattern, the above roller was dipped into warm water for five minutes to soften it. Then, while feeding the above viscous material to one side of the roller at the rate of 800 g/min. with a pressure feed pump (airless commander made by Daiei Kogyo, at 30:1), the roller was applied to a flexible board of the same shape as used in Example 1 once in the vertical direction, once along the left diagonal direction and once along the right diagonal direction (three times in total). The amount of application is 130 g.

(4) After-treatment

After the formation of the uneven pattern, the treated object was left for two hours, and then while still only partially solidified, a roller was applied to the convex portions of the uneven pattern to flatten the top portions thereof. Thereafter, the object was left for 15 hours at room temperature. Over the entire surface of the solidified uneven pattern a polyurethane resin metallic paint was applied twice.

Figure 6D:
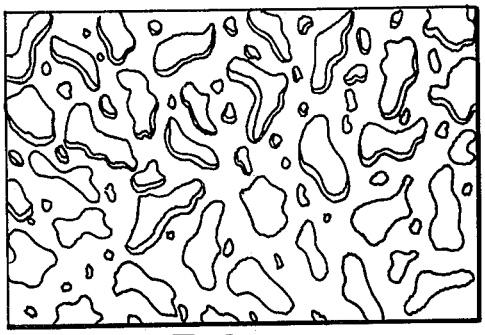

(5) The relief pattern thus formed had a large-figured texture without any directional traces, as shown in FIG. 6D, and was suitable for exterior finishing of a building.

EXAMPLE 3

(1) Roller

A roller of the same material as that of Example 2 having an inner diameter of 38 mm., an outer diameter of 70 mm., and a length of 180 mm. on the surface of which was formed the combined roller design arrangement of FIG. 4D, was used. The maximum dimension of each single design unit was approximately 70–80 mm. The spacing between adjacent similar portions of adjacent units was 5–8 mm., the thickness of the convex bodies was 2–3 mm., and the height of the convex bodies was 4–5 mm.

(2) Highly viscous material

| | |
|---|---|
| Vinylacetate acrylic emulsion | 20.0 (% by weight) |
| Filler (silica No. 6, No. 7) | 40.0 (% by weight) |
| Extender pigment | 13.0 (% by weight) |
| Tinting pigment | 12.0 (% by weight) |
| Dispersing agent | 1.5 (% by weight) |
| Thickner | 1.5 (% by weight) |
| Water | 12.0 (% by weight) |

A vinylacetate acrylic emulsion mastic paint of the above composition, available on the market, was used. The viscosity of the paint was 27,000 centipoise (at 18° C.).

(3) Formation of uneven pattern

In a manner similar to that of Example 2, the entire roller was softened, and then an uneven pattern was formed on the flexible board. The amount of the viscous material fed to the roller was 560 g./min., and the amount of its application to the roller was 92 g.

(4) After-treatment

After formation of the uneven pattern, the treated object was left for 15 hours at room temperature for solidification.

Figure 6E:
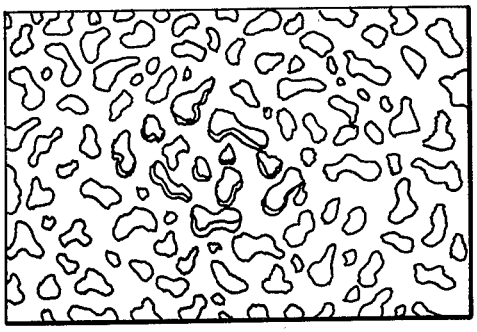

(5) The relief pattern thus formed was non-directional in texture as shown in FIG. 6E, and was suitable both for interior and exterior finishing of a building.

EXAMPLE 4

(1) Roller

A roller of the same material as that of Example 1 having an inner diameter of 43 mm. an outer diameter of 70 mm., and a length of 180 mm., on the surface of which was formed the combined roller design arrangement of FIG. 4F, was used. The maximum dimension of each single design unit was approximately 40–80 mm. The spacing between adjacent similar portions of adjacent units was 5–8 mm. the thickness of the convex bodies was 2–3 mm., and the height of the convex bodies was 3–4 mm.

(2) Highly viscous material

A vinylacetate vasatic emulsion type heavy-bodied paint of the same composition as that in Example 2 was used.

(3) Formation of uneven pattern

On the flexible board as mentioned in Example 1, 110 g. of the above viscous material was evenly applied with a wooden spatula to form a layer. Then, the above roller was applied twice in the lengthwise direction, once along the left diagonal direction, and once along the right diagonal direction (four times in total).

(4) After-treatment

After formation of the uneven pattern, the treated object was left for 15 hours at room temperature. The tops of the convex portions of the solidified uneven pattern were polished and flattened with coarse sand paper. Then, polyurethane resin paint (light blue or green) was twice sprayed over the entire surface of the uneven pattern. After the treated object had dried by being left for 15 hours, the same paint (white) was applied only to the tops of the convex portions of the plain uneven pattern with a roller.

Figure 6F:
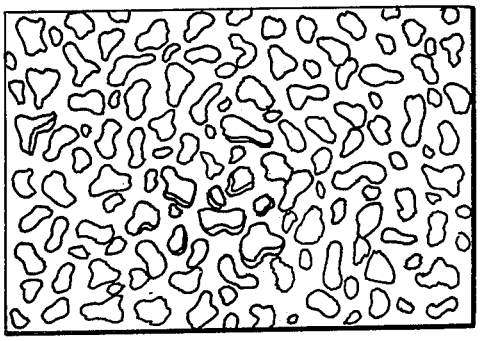
Figure 6G:
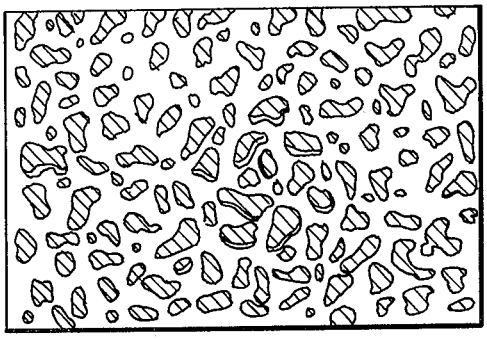

(5) The relief pattern thus formed was non-directional in texture as shown in FIG. 6G, and was suitable for both interior and exterior finishing of a structure.

EXAMPLE 5

(1) Roller

A roller of the same material and shape as that used in Example 4, on the surface of which was formed the combined roller design arrangement of FIG. 4E, was used. The maximum dimension of each single design unit was approximately 60–80 mm. The spacing between adjacent similar portions of adjacent units was 5–8 mm., the thickness of the convex bodies was 2–3 mm., and the height of the convex bodies was 3–4 mm.

(2) Highly viscous material

A vinylacetate vasatic emulsion type heavy-bodied paint of the same composition as in Example 2 was used.

(3) Formation of uneven pattern

The uneven pattern was formed in the same manner as described in Example 4.

(4) After-treatment

After formation of the uneven pattern, the treated object was left for 15 hours at room temperature for solidification. Then, polyurethane resin paint (light cream) was twice sprayed over the entire surface, and was left for 15 hours at room temperature.

(5) The relief pattern thus formed was non-directional in texture as shown in FIG. 6F, and was suitable mainly for the exterior finishing of a building.

EXAMPLE 6

(1) Roller

A roller of an elastic material prepared by hydrolyzing a polyurethane foam to thereby remove thin layers present in the pores and treating with neoprene, having an inner diameter of 40 mm., an outer diameter of 70 mm. and a length of 180 mm., on the surface of which was formed the roller design arrangement of FIG. 3B, was used. The thickness of the design elements was 10–13 mm. and the height thereof was 7–8 mm. The spacing between adjacent elements was 10–13 mm.

(2) Inorganic coating composition

| | |
|---|---|
| Paint Base: | |
| Water-dispersible epoxy resin | 25.0 (% by wt.) |
| Silica filler | 33.0 (% by wt.) |
| White cement | 15.0 (% by wt.) |
| Agent for increasing viscosity | 10.0 (% by wt.) |

-continued

| | |
|---|---|
| Silicone defoamer | 0.3 (% by wt.) |
| Plasticizer (DBP) | 10.0 (% by wt.) |
| Water | 10.0 (% by wt.) |
| Hardner: | |
| Water-soluble modified polyamide resin | |

A mixture of 100% by weight of such paint base with 7.5% by weight of such hardner was prepared by stirring for 1 to 2 minutes with a mixer. The viscosity of the coating composition was 380 poises (at 20° C.).

(3) Uneven pattern formation

A calcium silicate plate (500 mm.×500 mm.×12 mm.) which had been coated with a commercially available alkali sealer and dried was coated evenly with 1.0 Kg. of the composition by an applicator. The above roller was then applied once to three times in the lengthwise direction and in the diagonal direction to form an uneven pattern thereon.

(4) After-treatment

After forming the uneven pattern, the material was left at room temperature for 1.5 hours. The tops of the projections of the uneven pattern thus semi-solidified beyond a specified height were flattened to a uniform thickness with a commercially available press-levelling roller. The surface of the relief pattern was then dried for 16 hours and spray-coated three times with a commercially available polyurethane resin metallic enamel with 3-hour drying intervals.

(5) The relief pattern thus formed appeared to have a decorative pattern as shown in FIG. 6A without any directional traces, which was particularly suitable for exterior finishing of a building.

EXAMPLE 7

(1) Roller

A roller of the same material and shape as that used in Example 6, on the surface of which was formed the roller design arrangement of FIGS. 2D(i) and 3D, was used. The thickness of the design elements was 8–10 mm. and the height thereof was 7–8 mm., with a 8–10 mm. spacing between adjacent elements.

(2) Organic coating composition

| | |
|---|---|
| Vinyl acetate copolymer emulsion (VeoVa) | 16.0 (% by wt.) |
| Calcium carbonate pigment | 10.0 (% by wt.) |
| Silica filler | 50.0 (% by wt.) |
| Titanium oxide | 10.0 (% by wt.) |
| Thickner | 0.5 (% by wt.) |
| 25% Ammonia aqueous solution | 0.2 (% by wt.) |
| Silicone Defoamer | 0.3 (% by wt.) |
| Water | 13.0 (% by wt.) |

The viscosity of the composition was 230 poises (at 20° C.).

(3) Formation of uneven pattern

In a manner similar to that used in Example 6, a flexible board (500 mm.×500 mm.×6 mm.) was coated with 0.8 Kg. of the above coating composition by the above roller, thereby giving an uneven pattern.

(4) After-treatment

After the pattern was formed, the board was left for 2 hours at room temperature and treated in a manner similar to that used in Example 6. The relief pattern thus formed was suitable for interior finishing of a building.

I claim:

1. In a method of forming a decorative relief pattern comprising providing a layer of highly viscous material on the surface of an article or substrate to be patterned, and imparting a decorative relief pattern to said layer by rolling the surface of a roller over said layer a plurality of times necessary to cover the desired area of said surface of said article or substrate to be patterned, the improvement comprising performing said step of rolling while preventing the formation on said layer of directional traces indicative of the direction of rolling movement of said roller due to the formation of boundary lines in said layer at the ends of said roller, said improvement of preventing said directional traces comprising performing said rolling with the use of a roller consisting essentially of:

a roller surface having thereon a roller design arrangement consisting essentially of a single design unit occupying the entire said roller surface, said single design unit being formed of a plurality of design elements arranged around a common center of said single design unit, each said design element comprising a projection extending outwardly from said roller surface, each said projection extending in an elongated curved manner and having a flat outer top surface, and the spacings between any adjacent two of said design elements, taken along a straight line extending through said common center of said single design unit, being substantially equal.

2. The improvement claimed in claim 1, wherein at least certain of said projections are of a continuous linear shape.

3. The improvement claimed in claim 1, wherein at least certain of said projections are of a disconnected linear shape.

4. The improvement claimed in claim 1, wherein said roller is rolled a plurality of times over each of different portions of said layer.

5. The improvement claimed in claim 1, wherein said roller is rolled in a plurality of different directions over said layer.

6. The improvement claimed in claim 1, wherein said layer is first applied to said surface of said article or substrate to be patterned, and thereafter said roller is rolled over said layer.

7. The improvement claimed in claim 1, wherein said roller is applied while simultaneously feeding said viscous material to said surface of said article or substrate to be patterned.

8. The improvement claimed in claim 1, wherein said article to be patterned comprises a building wall element.

9. In a method of forming a decorative relief pattern comprising providing a layer of highly viscous material on the surface of an article or substrate to be patterned, and imparting a decorative relief pattern to said layer by rolling the surface of a roller over said layer a plurality of times necessary to cover the desired area of said surface of said article or substrate to be patterned, the improvement comprising performing said step of rolling while preventing the formation on said layer of directional traces indicative of the direction of rolling movement of said roller due to the formation of boundary lines in said layer at the ends of said roller, said improvement of preventing said directional traces comprising performing said rolling with the use of a roller consisting essentially of:

a roller surface having thereon a roller design arrangement consisting essentially of a plurality of design units together occupying the entire said roller surface, each said design unit having a center, each said design unit being formed of a plurality of design elements, each said design element comprising a projection extending outwardly from said roller surface, each said projection extending in an elongated curved manner and having a flat outer top surface, and said design units being asymmetrically and substantially equally spaced with respect to each other, with substantially equal distances between said centers of any adjacent two of said design units.

10. The improvement claimed in claim 9, wherein at least certain of said projections are of a continuous linear shape.

11. The improvement claimed in claim 9, wherein at least certain of said projections are of a disconnected linear shape.

12. The improvement claimed in claim 9, wherein said roller is rolled a plurality of times over each of different portions of said layer.

13. The improvement claimed in claim 9, wherein said roller is rolled in a plurality of different directions over said layer.

14. The improvement claimed in claim 9, wherein said layer is first applied to said surface of said article or substrate to be patterned, and thereafter said roller is rolled over said layer.

15. The improvement claimed in claim 9, wherein said roller is applied while simultaneously feeding said viscous material to said surface of said article or substrate to be patterned.

16. The improvement claimed in claim 9, wherein said article to be patterned comprises a building wall element.

* * * * *